US011686145B2

(12) United States Patent
Hall et al.

(10) Patent No.: US 11,686,145 B2
(45) Date of Patent: Jun. 27, 2023

(54) SHAFT MOUNTED OVERHEAD DOOR OPERATOR, CLUTCH AND KIT THEREFOR

(71) Applicant: Hall Labs LLC, Provo, UT (US)

(72) Inventors: David R. Hall, Provo, UT (US); Daniel Madsen, Vineyard, UT (US)

(73) Assignee: Hall Labs LLC, Provo, UT (US)

( * ) Notice: Subject to any disclaimer, the term of this patent is extended or adjusted under 35 U.S.C. 154(b) by 196 days.

(21) Appl. No.: 16/909,925

(22) Filed: Jun. 23, 2020

(65) Prior Publication Data

US 2021/0396063 A1 Dec. 23, 2021

(51) Int. Cl.
*E05F 15/00* (2015.01)
*E05F 15/668* (2015.01)
*E05F 15/41* (2015.01)

(52) U.S. Cl.
CPC ..... *E05F 15/668* (2015.01); *E05F 15/41* (2015.01); *E05Y 2201/434* (2013.01); *E05Y 2201/46* (2013.01); *E05Y 2900/106* (2013.01)

(58) Field of Classification Search
CPC . E05F 15/41; E05F 15/668; E05F 1/16; E05F 15/686; E05Y 2201/434; E05Y 2201/474; E05Y 2201/654; E05Y 2201/684; E05Y 2201/46; E05Y 2900/106; E05Y 2600/11; E05Y 2201/238; E05Y 2600/322; E05Y 2800/264; E05Y 2201/726; E05Y 2800/70; E05D 13/1261
USPC ..... 160/188, 189, 201; 49/118, 73.1, 136, 49/149, 157, 199, 200, 197
See application file for complete search history.

(56) References Cited

U.S. PATENT DOCUMENTS 5,929,580 A * 7/1999 Mullet ..... H02H 7/0851 160/292
6,253,824 B1 * 7/2001 Mullet ..... E05F 15/603 192/69.7
6,605,910 B2 * 8/2003 Mullet ..... E05F 15/668 318/264
7,607,263 B2 * 10/2009 Mullet ..... E05D 13/1261 160/188
8,037,922 B2 * 10/2011 Hawkins ..... E06B 9/68 160/310
8,935,883 B2 * 1/2015 Coubray ..... E05F 15/67 160/188
2011/0047877 A1 * 3/2011 Hellinga ..... E05D 15/24 49/139
2020/0018110 A1 * 1/2020 Lindley ..... E05D 13/1261
2021/0214974 A1 * 7/2021 Magro ..... E06B 9/70
2021/0270079 A1 * 9/2021 Hall ..... E05F 15/684
2021/0310294 A1 * 10/2021 Lindley ..... E05F 15/686
2021/0396059 A1 * 12/2021 Hall ..... E05F 1/16
2021/0404239 A1 * 12/2021 Hall ..... E05F 15/41

* cited by examiner

*Primary Examiner* — Chi Q Nguyen

(57) ABSTRACT

A shaft-mounted overhead door operator is disclosed having a motor, a torque transfer component such as a gear train, and a clutch that is axially movable to engage or disengage the clutch. While the door operator has power, the clutch is engaged to ensure door operator can raise, lower, and stop the overhead door as directed from a remote control. The clutch can be released in the event of a loss of power or by direction from the remote control in which case the clutch releases the shaft of the overhead door. The shaft-mounted overhead door is small, having a width no greater than three times the diameter of the shaft to which it is mounted.

20 Claims, 3 Drawing Sheets

SHAFT MOUNTED OVERHEAD DOOR OPERATOR, CLUTCH AND KIT THEREFOR

CROSS-REFERENCE TO RELATED APPLICATION

This application claims priority to U.S. Provisional Patent Application No. 62/884,131 entitled "GARAGE DOOR OPERATOR" filed on Aug. 7, 2019 which is incorporated herein by reference in its entirety.

TECHNICAL FIELD

This invention relates to overhead door operators.

BACKGROUND

Conventional overhead door openers are mounted to a ceiling above a middle of the overhead door when the door is in the raised position. These conventional overhead door openers present certain problems, not the least of which is the space they occupy. Many storage systems available today are prepared to make use of the space overhead in a garage, and conventional openers prevent this. In addition, most overhead door openers are relatively large and cumbersome to install and maintain. Furthermore, the locking mechanisms for these systems is indirect and can be unreliable.

SUMMARY

Embodiments of the present disclosure are directed to a shaft-mounted overhead door operator. The door operator includes a motor, a torque transfer component coupled to the motor and configured to receive power from the motor and transfer the power to a shaft of an overhead door, and a clutch. The clutch includes a first component coupled to the torque transfer component and a second component coupled to the shaft. The clutch also has a passive biasing member configured to urge the first component away from the second component in an axial direction generally parallel to the shaft, and a selectively releasable magnetic actuator configured to urge the first component toward the second component. The first and second component, when urged together by the selectively releasable magnetic actuator, interface to cause the first and second components to rotate together. When the selectively releasable magnetic actuator is released, the passive biasing member causes the first and second components to move away from one another in the axial direction thereby releasing the shaft from the torque transfer component thereby allowing the first and second components to rotate relative to one another. The door operator also includes a controller configured to issue commands to the motor and to receive communication from an external remote control to operate the motor in a forward direction, a rearward direction, to stop the motor, and to release the selectively releasable magnetic actuator.

Further embodiments of the present disclosure are directed to a clutch for a shaft-mounted overhead door operator. The clutch includes a collar configured to be attached to a shaft of an overhead door. The collar has a first locking surface. The clutch also includes a ring having a second locking surface configured to engage with the first locking surface and a motor-engaging surface opposite the second locking surface. When the collar and ring are urged together, the collar and ring prevent relative rotation between the collar and ring. The ring is coupled to a motor via the motor-engaging surface that is used by the motor to rotate the shaft to raise or lower the overhead door. The clutch also includes a passive biasing member configured to exert a first force between the collar and gear to urge the collar and gear away from one another. The clutch also includes a selectively activatable biasing member configured to exert a second force opposite and greater than the first force. The selectively activatable biasing member releases if power fails or in response to an instruction received from a remote control. The second force is greater than the first force, such that when power is provided to the clutch the clutch transfers torque from the motor to the shaft, and when without power the first force causes the collar and gear to disengage and release the shaft from the motor.

Still further embodiments of the present disclosure are directed to a kit for retrofitting an overhead door operator to a shaft of an overhead door. The kit includes a motor and a gear train coupled to the motor and to a shaft of an overhead door. Rotation of the shaft causes the overhead door to raise and lower. The gear train steps down an operating speed of the motor to raise and lower the door at a speed that is less than four times the operating speed of the motor. The kit also includes a clutch attached to an end of the shaft that protrudes laterally from the overhead door. The clutch includes a first component and a second component. At least one of the first and second components are movable between an engaged position and a disengaged position. At least one of the first and second component moves axially along the shaft away from the other component, thereby disengaging the clutch to release the shaft from the gear train. The clutch also includes a passive biasing component urging the first and second components away from one another toward the second position to disengage the clutch, and an active biasing component urging the first and second components toward one another toward the first position to engage the clutch. The active biasing component is stronger than the passive biasing component. If power fails the active biasing component also fails and the passive biasing component is then able to disengage the clutch. The kit also includes a controller configured to receive signals to operate the motor to raise, lower, or stop the overhead door, activate or deactivate the active biasing component to engage or disengage the clutch. The motor, gear train, clutch, and controller are encased in a housing that is approximately three times wider than a diameter of the shaft.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
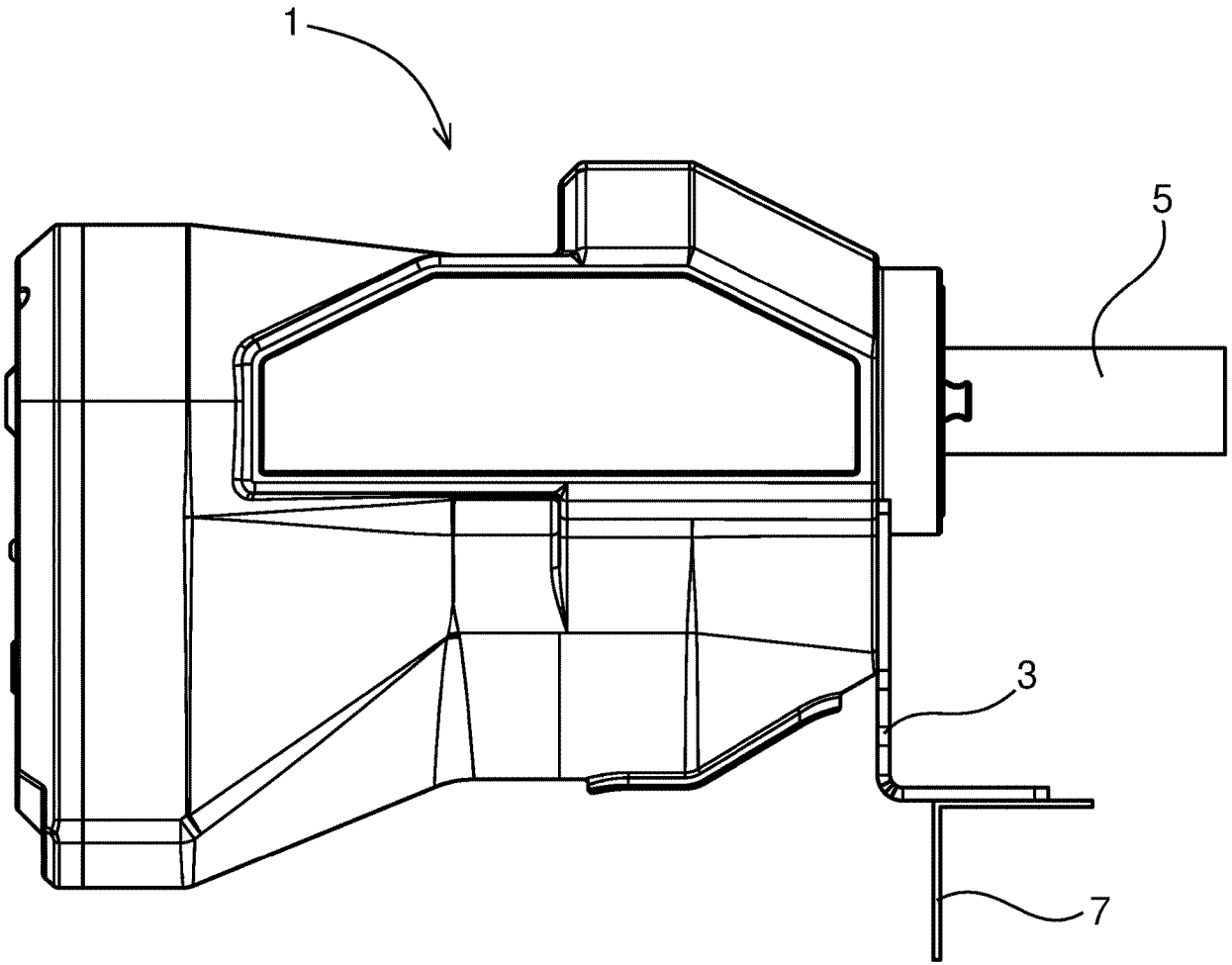
FIG. 1 is a front view of an overhead door operator according to embodiments of the present disclosure.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "sectional overhead door" is meant to refer to doors that open and close vertically and have multiple sections. Such doors are often found in Industrial buildings, warehouses, and residential garages. Throughout the specification the terms sectional overhead door and garage door are used interchangeably.

As used herein, "winch" or "lifting device" is meant to refer to devices with a motor attached to a drum for winding a line onto. One example of such lifting devices is available from MyLifter® and are described in U.S. Pat. Nos. 9,399,566; 9,567,195; 9,975,745 the contents of which are incorporated by reference.

As used herein, "lifter" is meant to refer to kits designed to lift specific objects, such as a paddleboard lifter is used to lift a paddleboard. The lifter utilizes at least one lifting device to lift, lower, and store objects. Lifter is also meant to refer to a single lifting device being used to lift and store objects even if it was not designed for use with a specific object.

A sectional overhead door is useful for opening a large section of a building. These doors are often heavy and cumbersome, which makes it difficult to open them by hand. Motorized sectional overhead door operators enable these doors to be opened and closed more easily and with additional safety.

A door system is generally attached to the walls of the building. The door generally rides on two tracks, one on each side of the door. Many door systems include a counterbalance system that utilizes torsion springs on an axle. This counterbalance system aids in opening and closing the door. The present invention utilizes this counterbalance system to open and close the door.

FIG. 1 is a front view of an overhead door operator 1 according to embodiments of the present disclosure. The overhead door operator 1 is referred to herein interchangeably as an overhead door operator, a sectional overhead door operator, a garage door operator, a door operator, and an operator. The door operator 1 is mounted to a shaft 5 and is configured to rotate the shaft 5 to raise and lower a overhead door (not pictured), such as the typical sectional type garage door. The door operator has a bracket 3 that is mounted to a frame 7. The frame 7 can be a frame portion of the overhead door, or it can be mounted to the wall, or it can be any other suitably strong, rigid member to which the door operator 1 can be securely mounted with sufficient strength to provide an anchor point for the door operator 1 as the door operator 1 exerts forces on the overhead door in raising, lowering, and holding the position of the sectional overhead door. In some embodiments the bracket 3 and frame 7 are L-shaped brackets held together by fasteners such as bolts or screws or other suitable means.

The door operator 1 is mounted with the shaft 5 within a central bore of the door operator 1. As will be described herein, the door operator 1 is configured to operate doors that are mounted to shafts such as the shaft 5 to raise and lower the sectional overhead door. This may include roll-up doors that wind around the shaft. It may also include sectional doors or any other type of overhead door that is operated by a rotating shaft. In convention doors, the shaft 5 is used to wind cables which are connected to the overhead door to raise and lower the overhead door. A spool can be connected to the shaft that winds the cables.

Figure 2:
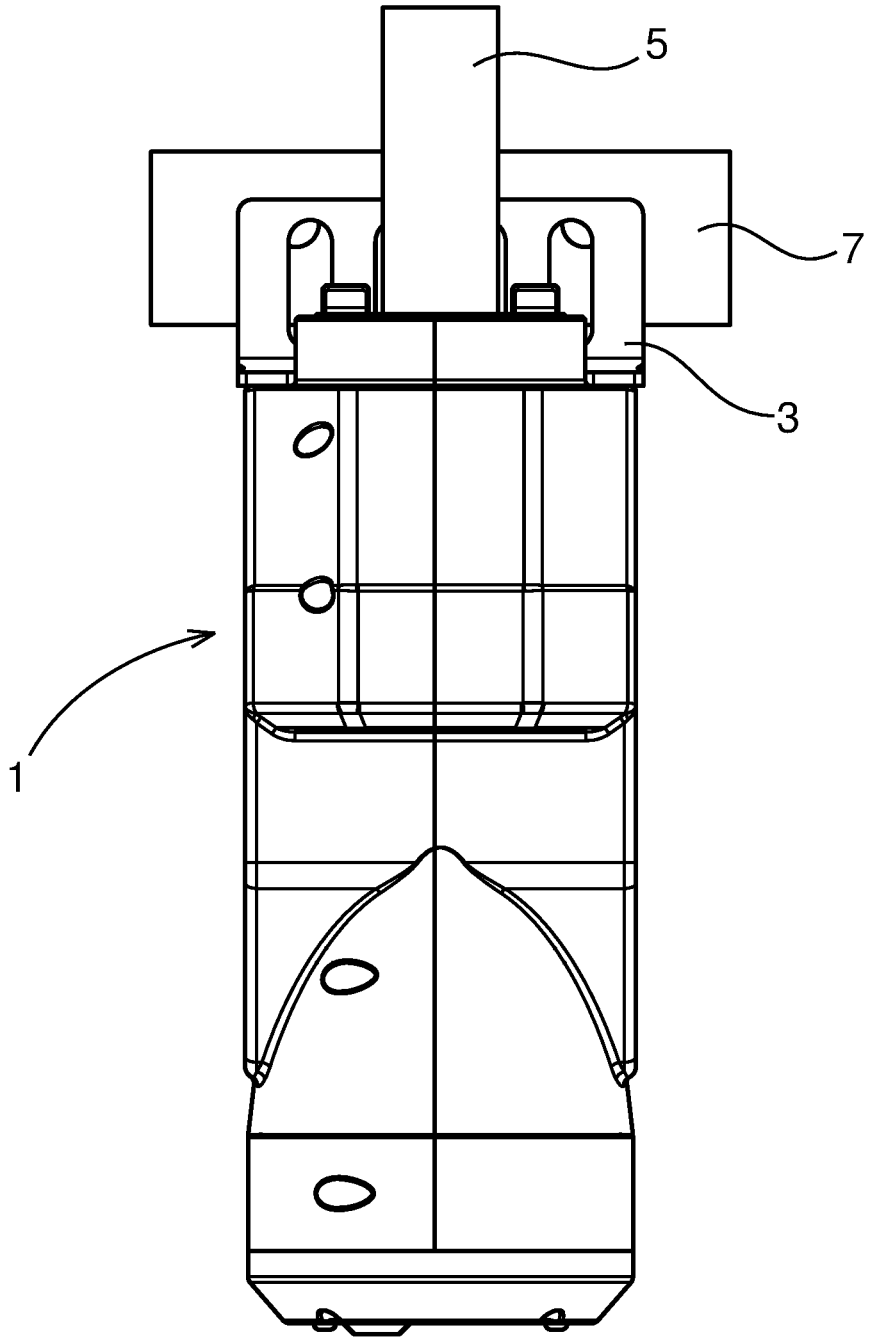
FIG. 2 is a top view of the sectional overhead door operator according to embodiments of the present disclosure.

FIG. 2 is a top view of the sectional overhead door operator 1 according to embodiments of the present disclosure. The bracket 3 and frame are shown with holes in each to facilitate fastening the bracket 3 and frame 7 together. The shaft 5 can be seen protruding from the operator 1.

Figure 3:
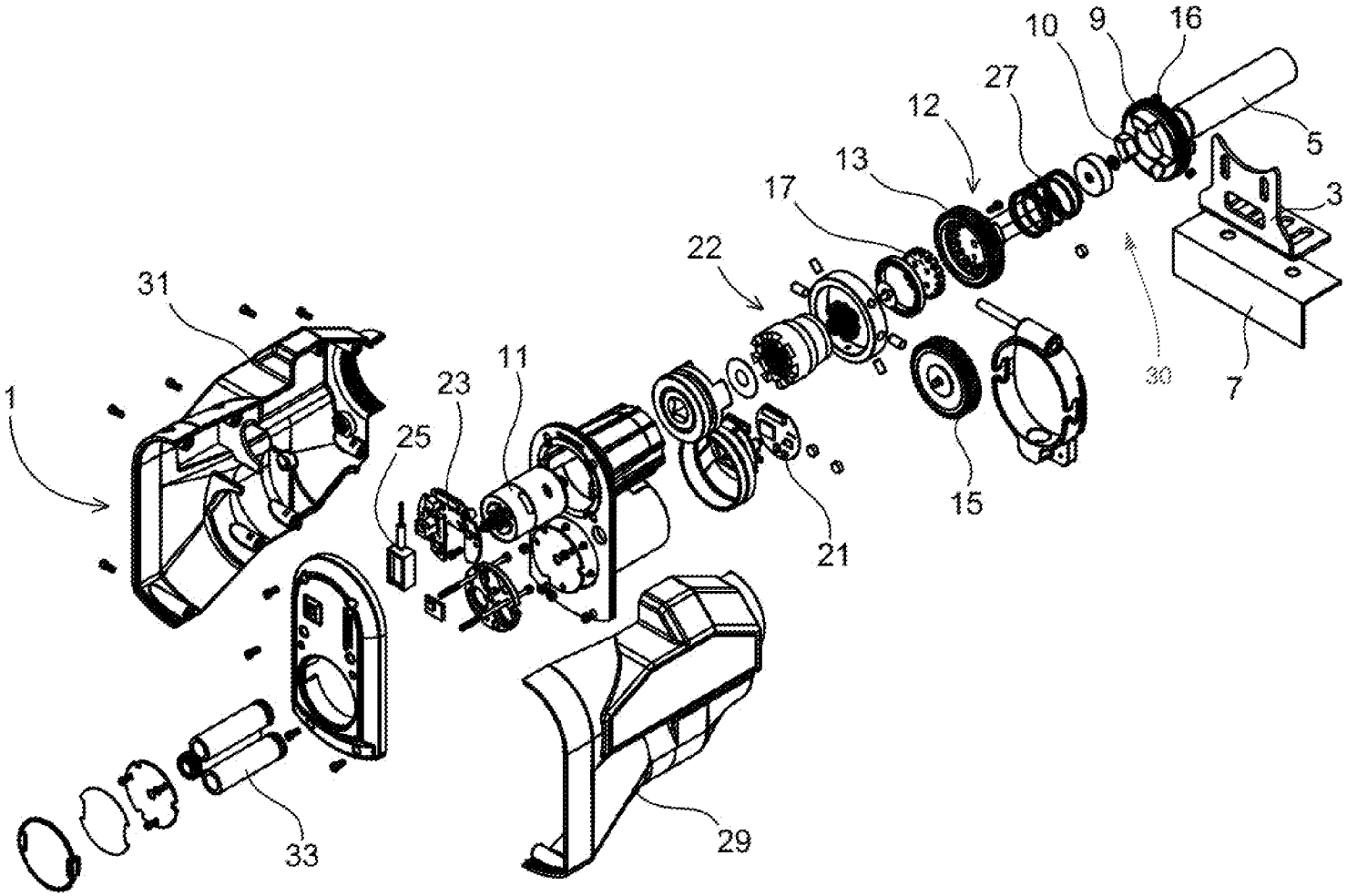
FIG. 3 is an exploded view of the sectional overhead door operator according to embodiments of the present disclosure.

FIG. 3 is an exploded view of the sectional overhead door operator 1 according to embodiments of the present disclosure. The operator 1 includes a locking collar 9 which is secured to the shaft 5. The locking collar 9 can be a spider coupler or another suitable type of coupler that can be selectively engaged or disengaged. The locking collar 9 is secured to the shaft 5 by set screws 16. The locking collar 9 has protrusions 10 which extend axially from the locking collar 9 and engage with a gear 13 which has corresponding recessions 12 configured to receive the protrusions 10 in a way to prevent relative rotation when the locking collar 9 is held against the gear 13. In other embodiment the recessions 12 are found in another component that is not a gear. The locking collar 9 can be magnetically biased toward the gear 13, such that the magnetic force causes the locking collar 9 to be engaged and to prevent rotation of the shaft 5 relative to the door operator 1. When such rotation is prevented, operation of the sectional overhead door operator 1 causes the shaft 5 to rotate which in turn causes the overhead door to raise and lower on command as the system is intended to do. When the locking collar 9 is released axially away from the gear 13 such that the protrusions 10 are not held within the recessions 12, the shaft 5 is permitted to rotate relative to the door operator 1.

In some embodiments there is a spring 27 between the locking collar 9 and the gear 13 that urges the locking collar 9 away from the gear 13, such that when the magnetic bias fails, or another release is triggered in response to a command or in the case of power failure, the spring 27 will urge the protrusions 10 out of the recessions 12, and the shaft 5 is free to rotate. Accordingly, the locking collar 9 is configured to release in the event of a manual release, a power failure, or a remotely requested release, any of which will cease power to the magnetic force that holds the locking collar 9 against the gear 13.

In some embodiments the motor assembly 22 is configured to convert electrical energy received from batteries or from an outlet into rotational energy. The gears 13, 15, 17, can collectively be referred to as a torque transfer component that is coupled to the motor assembly 22.

In some embodiments the locking collar 9 and the gear 13 together comprise a clutch 30 that is movable between an engaged position and a disengaged position. In the engaged position the movement of the door is fixed to the movement of the door operator 1, and when in the open position the door shaft 5 is permitted to rotate relative to the door operator 1, which in turn allows the door to raise and lower without movement of the door operator 1. The clutch 30 can be actuated by axial movement of the locking collar 9 and gear 13. In some embodiments the gear 13 can be referred to as a first component and the locking collar 9 can be referred to as a second component of the clutch 30. In some embodiments the first and second components are pressed together by a magnet or a spring or another component applying an axial force to urge the first and second components together. The first and second components may interlock such that without axial movement they will not separate to release the shaft 5.

In other embodiments the first and second components form a friction fit that can be overcome by a sufficient force. Sufficient torque on the shaft 5 will cause the lock to release. In some embodiments the amount of torque required is larger than the torque caused by normal operation of the door. That is, without any pulling or pushing on the door or shaft the lock does not release, but if the door is pushed or pulled manually up or down, the friction fit will release to release the lock.

In some embodiments the surface of the locking collar 9 and gear 13 are locking surfaces that may include interlocking features such as protrusions 10 and recessions 12, or they can be flat surfaces that rely on friction between them to transfer torque.

The force pressing the clutch 30 together can be referred to as an active biasing member. In some embodiments the active biasing member is a selectively releasable magnetic coupler. The force pushing the clutch 30 apart can be passive, such as a passive spring 27 or another biasing member. The spring 27 can be a helical spring wound around a portion of the shaft 5.

The interior components of the door operator 1 are enclosed by and held within housing sides 29 and 31. Locking collar 9 fits within and rotates within the rounded opening of housing sides 29 and 31. The shaft 5 is rotated by motor assembly 22. The motor assembly 22 is a high rpm motor. The door operator 1 includes a series of gears 13, 15, and 17 to step down the speed of the motor. In some embodiments the speed can be stepped down by a factor of at least four.

Controllers 21 and 23 include processors, memory, wireless transceivers and all the hardware necessary for the door operator to connect to and communicate with remote control devices. Generally, the remote-control device will be a smartphone with an app configured for controlling the door operator. The app will include options for programming the door operator 1 as well as providing continuous control. The processor on the controller allows the door operator 1 to receive operating parameters and safety parameters. Preferably, the wireless transceivers are Bluetooth transceivers. In other embodiments the wireless transceivers are WIFI or RF transceivers.

In some embodiments the overhead door operator is relatively small compared to conventional openers. The envelope of the door operator can be less than six inches wide and less than six inches tall. In some embodiments the door operator has a width no greater than three times a diameter of the shaft and a height no greater than four times the diameter of the shaft.

Additional methods for instructing the garage door operator to open and close the garage door are available. A wall mounted button opens and closes the garage door. Remote garage door openers, which are single purpose devices, enable remote opening and closing of the garage door. A numeric keypad also wirelessly connects to the garage door operator.

In addition to connecting and communicating with lifter kits. The controllers 21 and 23 connect and communicate with environmental sensors. These sensors include, temperature sensors, pressure sensors, carbon monoxide sensors, weather sensors, other chemical sensors, and other sensors. The door operator is thus able to assist in keeping conditions safe. For example, if a carbon monoxide sensor senses the presence of carbon monoxide above a certain threshold the sensor will send a signal to the door operator that the level of carbon monoxide in the area is above that threshold. The processor in the door operator will cause the operator to open the garage door. This will allow the carbon monoxide to escape and fresh air to enter. Thresholds above or below which the door should be opened or closed are programmed into the door operator. Owners of the door operator will also be able to set their own conditions for automatic opening or shutting of the garage door. The door operator could be programmed to instruct the door to be closed if a snowstorm is will arrive.

Rechargeable batteries 33 provide power for the door operator. The batteries also allow the garage door to be opened in the event of a power outage. The charge on the batteries is maintained by a low power charger.

Though powered by batteries 33, there are still instances where manual operation of the garage door will be necessary. The door operator 1 is able to be decoupled manually. In some embodiments the axle is decoupled from the motor by pulling on a rope and moving a gear out of alignment with the other gears. In other embodiments the axle is decoupled by loosening the locking collar.

All patents and published patent applications referred to herein are incorporated herein by reference. The invention has been described with reference to various specific and preferred embodiments and techniques. Nevertheless, it is understood that many variations and modifications may be made while remaining within the spirit and scope of the invention.

What is claimed is:

1. A shaft-mounted overhead door operator, comprising:

a motor;

a torque transfer component coupled to the motor and configured to receive power from the motor and transfer the power to a shaft of an overhead door;

a clutch comprising:

a first component coupled to the torque transfer component;

a second component coupled to the shaft;

a passive biasing member configured to urge the first component away from the second component in an axial direction generally parallel to the shaft; and a selectively releasable magnetic actuator configured to urge the first component toward the second component, wherein the first and second components, when urged together by the selectively releasable magnetic actuator interface to cause the first and second components to rotate together, wherein as the selectively releasable magnetic actuator is released, the passive biasing member causes the first and second components to move away from one another in the axial direction thereby releasing the shaft from the torque transfer component thereby allowing the first and second components to rotate relative to one another; and a controller configured to issue commands to the motor and to receive communication from an external remote control to operate the motor in a forward direction, a rearward direction, to stop the motor, and to release the selectively releasable magnetic actuator.

2. The shaft-mounted overhead door operator of claim 1, wherein the motor has a rotational speed that is at least four times a speed of rotation of the shaft, and wherein the torque transfer component comprises gears that step down the speed of the motor to achieve a desired speed for the overhead door.

3. The shaft-mounted overhead door operator of claim 1, further comprising a battery configured to provide power to the motor if there is a power failure to the motor.

4. The shaft-mounted overhead door operator of claim 3 wherein the controller can direct the battery to direct power to the selectively releasable magnetic actuator upon a command from the external remote control.

5. The shaft-mounted overhead door operator of claim 1 wherein the torque transfer component comprises a series of interlocking gears.

6. The shaft-mounted overhead door operator of claim 1 wherein the torque transfer component comprises a gear that is integral with the first component of the clutch.

7. The shaft-mounted overhead door operator of claim 1 wherein the passive biasing member comprises a helical spring positioned around the shaft.

8. The shaft-mounted overhead door operator of claim 1 wherein the first and second components each has friction-based, flat locking surface, wherein a sufficient torque causes the first and second components to slip relative to one another to allow relative rotation between the first and second components.

9. The shaft-mounted overhead door operator of claim 1 wherein the overhead door operator has a width no greater than three times a diameter of the shaft and a height no greater than four times the diameter of the shaft.

10. A clutch for a shaft-mounted overhead door operator, the clutch comprising:

a collar configured to be attached to a shaft of an overhead door, the collar having a first locking surface;

a ring having a second locking surface configured to engage with the first locking surface and a motor-engaging surface opposite the second locking surface, wherein when the collar and ring are urged together the collar and ring prevent relative rotation between the collar and ring, wherein the ring is coupled to a motor via the motor-engaging surface, and wherein thereby the motor operates to rotate the shaft to raise or lower the overhead door;

a passive biasing member configured to exert a first force between the collar and gear to urge the collar and gear away from one another; and a selectively activatable biasing member configured to exert a second force opposite and greater than the first force, wherein the selectively activatable biasing member releases in response to a power failure or in response to an instruction received from a remote control, wherein the second force is greater than the first force, such that when power is provided to the clutch the clutch transfers torque from the motor to the shaft, and when without power the first force causes the collar and gear to disengage and release the shaft from the motor.

11. The clutch of claim 10 wherein the first and second locking surfaces comprise mechanically interlocking features.

12. The clutch of claim 10 wherein the first and second locking surfaces comprise friction surfaces that are overcome with sufficient torque.

13. The clutch of claim 10 wherein the collar and ring engage and release by moving in an axial direction generally parallel with the shaft.

14. A kit for retrofitting an overhead door operator to a shaft of an overhead door, the kit comprising:

a motor;

a gear train coupled to the motor and to a shaft of an overhead door, wherein rotation of the shaft causes the overhead door to raise and lower, and wherein the gear train steps down an operating speed of the motor to raise and lower the door at a speed that is less than four times the operating speed of the motor;

a clutch attached to an end of the shaft that protrudes laterally from the overhead door, the clutch comprising:

a first component;

a second component, wherein at least one of the first and second components are movable between an engaged position and a disengaged position, wherein at least one of the first and second component moves axially along the shaft away from the other component, thereby disengaging the clutch to release the shaft from the gear train;

a passive biasing component urging the first and second components away from one another toward the second position to disengage the clutch; and an active biasing component urging the first and second components toward one another toward the first position to engage the clutch, wherein the active biasing component is stronger than the passive biasing component, and wherein if power fails the active biasing component also fails and the passive biasing component is then able to disengage the clutch;

a controller configured to receive signals to:

operate the motor to raise, lower, or stop the overhead door;

activate or deactivate the active biasing component to engage or disengage the clutch;

wherein the motor, gear train, clutch, and controller are encased in a housing that is approximately three times wider than a diameter of the shaft.

15. The kit of claim 14 wherein the passive biasing component comprises a helical spring wound around the shaft.

16. The kit of claim 14 wherein the first and second component of the clutch encircle a portion of the shaft.

17. The kit of claim 14 wherein the first and second component have interlocking features.

18. The kit of claim 14 wherein the first and second component transfer torque through a friction fit.

19. The kit of claim 18 wherein the friction fit can be overcome by application of torque above a predetermined level thereby releasing the lock.

20. The kit of claim 14, further comprising a battery pack configured to provide backup power to at least one of the controller, motor, or clutch.

* * * * *